US006764431B2

(12) United States Patent
Yoss

(10) Patent No.: US 6,764,431 B2
(45) Date of Patent: Jul. 20, 2004

(54) SWIM MACHINE

(76) Inventor: Mark Stuart Yoss, 2922 E. Montclair Ct., Highlands Ranch, CO (US) 80126

( * ) Notice: Subject to any disclaimer, the term of this patent is extended or adjusted under 35 U.S.C. 154(b) by 364 days.

(21) Appl. No.: 09/895,715

(22) Filed: Jun. 29, 2001

(65) Prior Publication Data

US 2003/0004036 A1 Jan. 2, 2003

(51) Int. Cl.[7] ..... A63B 69/10
(52) U.S. Cl. ..... 482/56; 434/254
(58) Field of Search ..... 482/51, 55–56, 482/142, 131; 601/26, 33–35, 86, 90, 98; 434/247, 254

(56) References Cited

U.S. PATENT DOCUMENTS 2,013,520 A * 9/1935 McDermott ..... 482/56
2,019,224 A * 10/1935 Hess ..... 482/56
3,074,716 A * 1/1963 Mitchel et al. ..... 482/56
4,358,105 A 11/1982 Sweeney
4,674,740 A * 6/1987 Iams et al. ..... 482/56
4,708,338 A 11/1987 Potts
4,830,363 A * 5/1989 Kennedy ..... 482/56
5,269,736 A 12/1993 Roberts
5,393,280 A * 2/1995 Haviv ..... 482/56
6,352,493 B1 * 3/2002 Davis ..... 482/56

* cited by examiner

*Primary Examiner*—Stephen R. Crow

(57) ABSTRACT

An out of water swimming exercise device is described. An adjustable exercise bench is combined with a pedal mechanism for simulating arm motions and a stair climber mechanism for simulating leg motions. The pedal mechanism is rotated by telescopic cranks attached with universal joints and engaged by handgrips. The stair climber mechanism is pivoted by lever bars and engaged by the user's legs with cushioned rolls. Three different swim strokes can be simulated, including; freestyle, backstroke and butterfly. The exercise device is fully adjustable to different sizes of users. Accessory devices such as heart rate monitors, lap/distance counters, timers and the like can be attached to the device.

14 Claims, 7 Drawing Sheets

SWIM MACHINE

BACKGROUND OF THE INVENTION

This invention relates to exercise devices, specifically an out of water type swimming exercise device.

Major fitness activities such as running, cycling, rowing and cross-country skiing all have exercise equipment that allow for performance of the activity inside one's own home or at the local health club. Swimming enjoys a large participation share yet there is no commercially available indoor exercise equipment to simulate it. While numerous patents are documented in the out of water type swimming field, a search of the local fitness equipment dealer will not result in a device that can be purchased, proving the failure of prior art.

Typical prior art has proven to be cumbersome and inconvenient. Most attempts have sought to incorporate pulleys and cables for both the arm and leg motions of swimming. Pulleys and cables have failed to provide consistent resistance throughout the simulated swimming stroke. U.S. Pat. No. 5,269,736 to Roberts (1993) deviated from pulleys and cables and employs a pedal mechanism for the arm motion that is operated by the hands. While this pedal mechanism is proven and widely used in the stationary bicycle field, it has a fixed path of operation that fails to provide for the full asymmetrical motion of the arms in a simulated swimming stroke. Additionally, U.S. Pat. No. 4,674,740 to lams and Splane (1987) uses a novel approach beyond cables that employs telescopic crank arms with resistance from a cam-and-belt mechanism. The intent is to simulate the "water line" and provide the corresponding resistances and reciprocal motions of actual swimming. In reality, significant resistance under the water line and minimal resistance above the water line requires advanced coordination obtained only through extensive practice. The first time user of this configuration finds it awkward and is quick to abort the exercise. Likewise, U.S. Pat. No. 4,830,363 to Kennedy (1989) deviated from pulleys and cables and employs cushioned leg rolls with hydraulic shocks for the leg motion of the exercise. While this cushioned leg roll approach is proven and widely used in the leg extension/flexion field of weight lifting, the hydraulic shocks have a slow response rate that significantly prohibits the simulation of a swimming flutter kick.

BRIEF SUMMARY OF THE INVENTION

Accordingly, convenience and consistent resistance with electronic control are advantages of my invention. My swim machine combines a pedal mechanism with a telescopic crank for the arm movements of the exercise. Left and right telescopic cranks are attached to the pedal mechanism by means of two universal joints. The universal joints and the telescopic cranks allow for the infinite range of arm motions in any plane. The pedal mechanism provides for adjustable continuous resistance that allows the user to select any level of physical exertion desired. The greater the resistance, the more difficult the exercise is to perform and the greater the physiological benefits. For the leg motion, my invention utilizes cushioned leg rolls attached to pivoting lever bars. The leg portion also provides for adjustable continuous resistance that allows the user to select any level of physical exertion desired. The arm and leg mechanisms of my invention are supported on an adjustable height and length exercise bench. Convenience is found in the fact that the user simply lies on a bench, grasps the handles of the telescopic cranks and engages the legs with the cushioned rolls to begin exercising. A keyboard and display panel used to communicate between a microcomputer and alternators of the arm and leg mechanisms provides for the user to select from a plurality of stored programs or generate a random program.

To begin the freestyle swim stroke, the hands must be 180 degrees from each other with one hand extended forward and the second hand to the rear by the hip. The user can now perform the windmill motion of the stroke along with the alternating flutter kick. The telescopic cranks and universal joints allow for the asymmetrical rotation of the swim stroke while providing continuous resistance from the pedal mechanism. Further, the bench allows for the tilt of the user's torso during the swim stroke by providing a pair of swivel joints.

In the backstroke, the user sits down and leans back onto the hinged bench, which can be inclined and performs the windmill motion of the arms along with the alternating flutter kick. Again, the swivel joints allow for the tilt of the user's torso during the swim stroke.

The butterfly swim stroke can also be performed. In this case both hands must be at the same angle from the body and extended forward. Likewise, both legs are adjacent to each other by locking the pivoting lever bars together. The arms and legs work in synchronization to each other throughout the windmill motion and the dolphin kick. The seat allows for the up and down movement of the user's hips by employing a swivel joint.

This out of water swimming exercise device is advantageous over water swimming in that it avoids the dry/itchy skin and damaged/brittle hair that is so common from the chemicals used in swimming pools. Additionally, the out of water usage allows for performance of the exercise in the privacy of one's own home, thereby avoiding the embarrassment that some individuals have with being seen by others in form fitting swimwear.

When comparing fitness activities for number of calories burned, swimming ranks high on the list. An exercise device that allows an individual to swim all year round, despite the availability of a pool or favorable climate, provides a benefit that cannot be ignored.

A May 1999 study conducted by American Sports Data for the Sporting Goods Manufacturers Association found that there are 80,864,000 recreational walkers in the United States, 54,575,000 recreational bicyclers and 94,371,000 recreational swimmers. The same study also found that there are 37,073,000 treadmill users, 30,791,000 stationary cycle users and zero swim machine users. The number of treadmill users translates to forty-six percent of walkers and the stationary cyclers translates to fifty-six percent of bicyclers. Averaging these two percentages allows for extrapolation of 48,327,000 potential users of a swim machine. This number represents a significant target market.

A general object of the present invention is to provide an improved exercise apparatus.

It is another object of the invention to provide an exercise apparatus, which provides a scientifically maximum exercise benefit within the minimum amount of time.

It is another object of the invention to provide an improved exercise apparatus, which motivates the user to improve his/her progress.

It is another object of the invention to provide an exercise apparatus, which is convenient to use both in time and in place.

It is another object of the invention to provide an exercise apparatus in which the progress of the user is easily measured.

It is another object of the invention to provide an exercise apparatus where the user's work level can be easily measured whereby the user's maximal oxygen uptake can be calculated.

It is another object of the invention to provide an exercise apparatus, which allows the user to maintain an identical work effort from day to day.

It is another object of the invention to provide an exercise apparatus, which automatically provides interval training with progressive overload.

Further objects and advantages of my invention will become apparent from a consideration of the drawings and ensuing description.

DETAILED DESCRIPTION OF THE INVENTION

Figure 1:
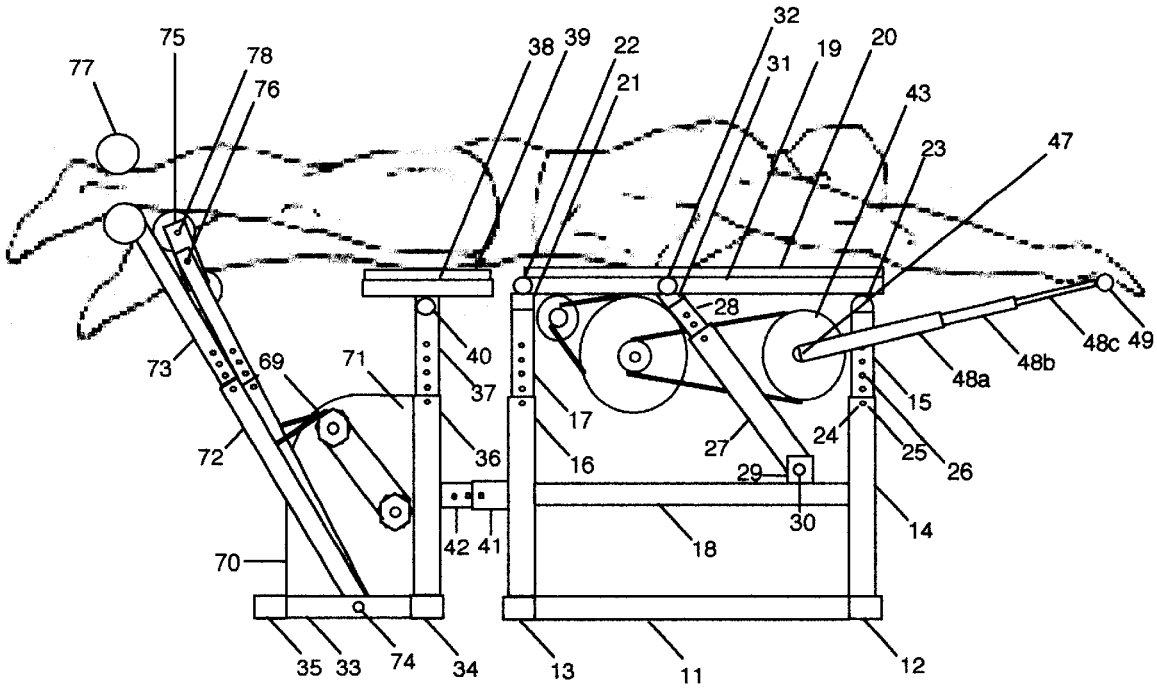
FIG. 1 is a side view of my invention with a user engaged in the freestyle swim stroke.
Figure 2:
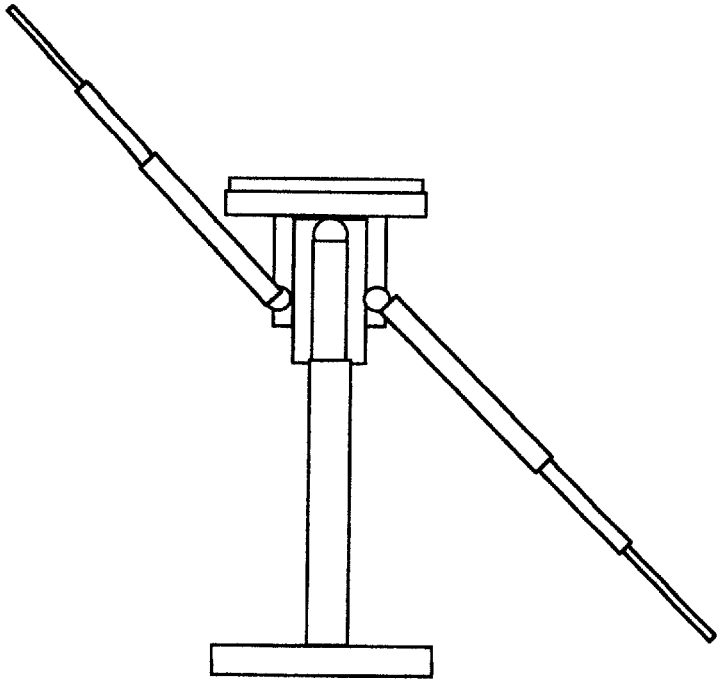
FIG. 2 is a front view of my invention.

In the following description similar features in the drawing were given similar numerals. While the invention to be described is in conjunction with a preferred embodiment, it will be understood that it is not intended to limit the invention to such embodiment. On the contrary, it is intended to cover all alternatives, modifications and equivalents as may be included within the spirit and scope of the invention as defined by the appended claims.

Referring to FIG. 1 there is illustrated a swim machine in accordance with the present invention.

The apparatus comprises two separate benches to support a user, the torso frame 19 and seat frame 38. The torso bench is supported above the floor by a torso base 11, torso front foot 12 and torso rear foot 13 with a combination of front and rear sleeves 14/16 and inserts 15/17. The front and rear sleeves are connected by transverse bar 18. The height of the bench is adjusted by set pins 24 through sleeve location holes 25 and into corresponding insert adjustment holes 26. The seat frame is supported above the floor by a seat base 33, seat front foot 34 and seat rear foot 35 with a seat sleeve 36 and seat insert 37. The height of the seat is adjusted by set pin 24 through sleeve location hole 25 and into corresponding insert adjustment holes 26. Each of the torso and seat frames is covered by a cushioned board 20/39, which serves as the user contact surface.

The tubing of the frame, base, feet, sleeves and inserts may have any suitable cross-sectional shape including square or circular. Further, the tubing is not intended to be limited by a particular material of construction. Any material that can withstand the rigors of operation may be utilized. Suitable materials include metals, alloys, high strength plastics, and fiber-reinforced materials such as graphite reinforced plastic materials.

Torso and seat cushions are preferably constructed of materials suitable to endure the rigors of exercise use to which they will be subjected. Suitable materials include open cell foam, closed cell foam, sponge rubber and gel filled materials. Typically the cushion is covered with plastic, vinyl or other material suitable to withstand repeated and prolonged exposure to perspiration. Torso and seat boards can be various shapes including angled corners, rounded corners and custom fit for user's arm clearance.

A combination of torso swivel joint 21, incline swivel joint 31 and ball and socket joint 23 allow for axial rotation of the torso bench which is critical to simulate the natural shoulder rotation of the freestyle swim stroke. Torso swivel joint 21 is attached to the rear insert 17 and to the torso frame 19. Incline swivel joint 31 is attached to the incline insert 28 and to the incline hinge 32. Ball and socket joint 23 has the ball on the top of the front insert 15 and the socket on the bottom of the torso frame 19.

A seat swivel joint 40 is attached to the seat insert 37 and to the seat frame 38 which allows for the seat to pivot which is critical to the natural dolphin like hip motion of the breast stroke.

A torso hinge 22 and incline hinge 32 allow for the torso bench to be inclined to aid in television viewing during the back stroke. The bench is supported in the incline mode by an incline sleeve 27 and insert 28 that is adjustable by using set pin 24 in sleeve location hole 25 into corresponding insert adjustment holes 26. The incline sleeve 27 is connected to transverse bar 18 by incline bracket 29. Incline dowel 30 is inserted through one side of incline bracket 29, passes through incline sleeve 27, and finishes through the second side of incline bracket 29. This dowel allows for the sleeve and insert to pivot with the inclining of the bench.

Adjusting the distance between the torso bench and the seat provides for the height of a user. Set pin 24 is placed in sleeve location hole 25 of torso/seat link sleeve 41 and into a corresponding insert adjustment hole 26 of torso/seat link insert 42.

Pedal mechanism 43 is a conventional pedal crank assembly and is mounted underneath torso frame 19. This pedal mechanism is rotated by two non-conventional telescopic arm cranks 48 attached to the pedal mechanism drive sprocket 46 at each end by universal joints 47. Telescopic arm cranks 48 terminate at their outward end in multi-motion apparatus 49 to which is attached handgrip 50. Telescopic arm cranks 48 are constructed of three or more telescoping sections 48*a*, 48*b* and 48*c*. The telescoping feature allows the arm cranks length to vary as the user moves his arms in the natural swimming motion. Thus, the normal arm strokes of swimming can be properly simulated, rather than having the user's arms artificially forced to maintain a fixed extension in the manner of many prior art devices.

The handgrips 50 can be as shown in the form of rotatable rods which are actually gripped by the user. Alternatively, the handgrips 50 could be in the form of flat pads on which the user lays his hands to give more of the simulation of the extended hand position common to swimming. A strap or similar restraining device would secure the user's hand to the 'paddle type' handgrips 50. In an alternative but less preferred embodiment the handgrip 50 could be in the form of a glove or mitten in which the user places his hands.

Figure 4:
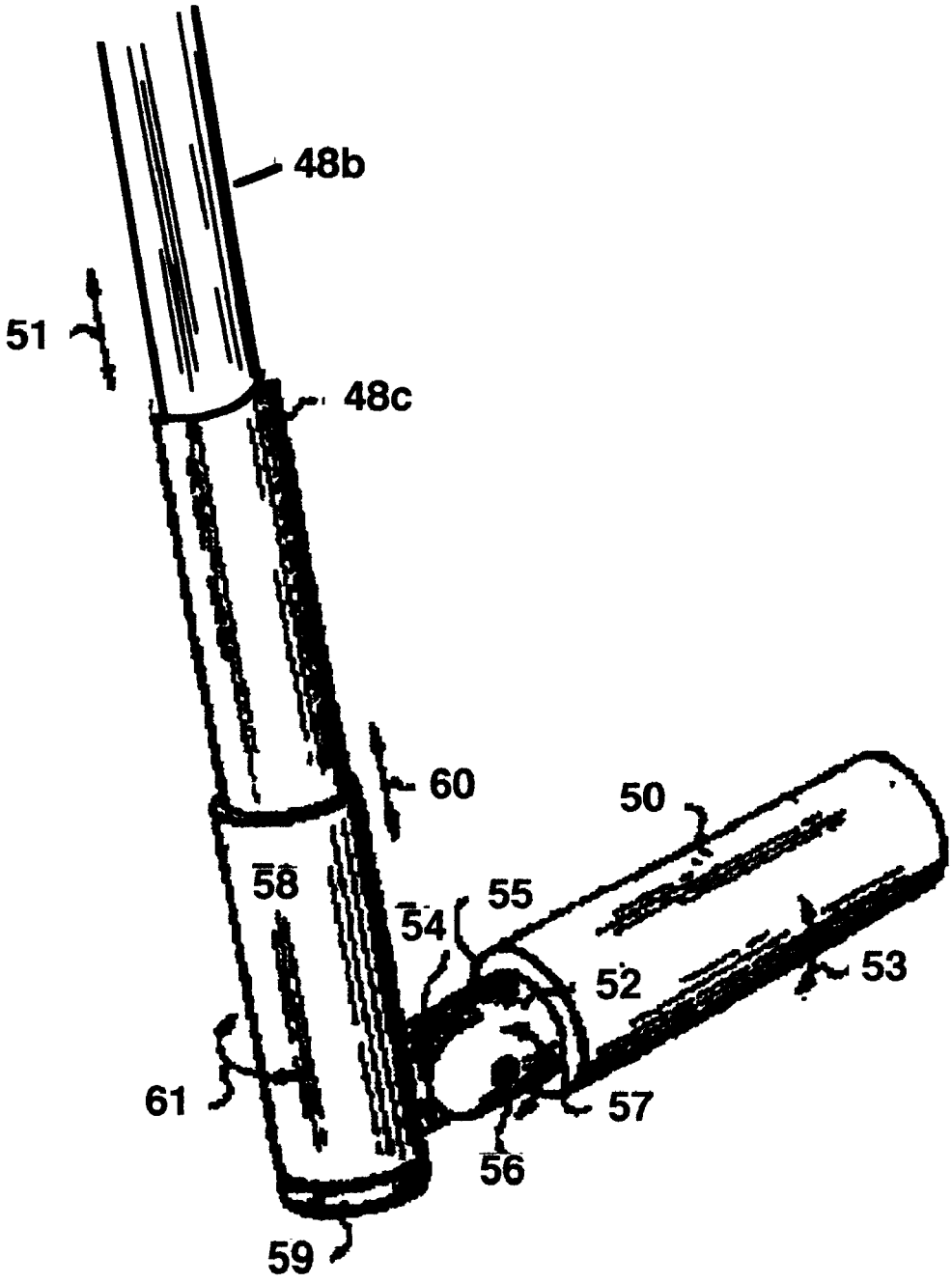
FIG. 4 is a detail view of the multi-motion apparatus of my invention.

The details of the different degrees of motion available for the user's arms in multi-motion apparatus 49 are shown in FIG. 4. The telescoping relationship of arm cranks 48 sections 48*a*, 48*b* and 48*c* allow for extension and retraction of the arm crank 48 as indicated by arrow 51. Handgrip 50 is rotatably mounted on shaft 52 providing for rotational motion as indicated by arrow 53. The inward end of shaft 52 terminates in a swivel joint formed by tongue 54 being fitted in slot 55 and pinned by bolt 56, thus permitting the swivel motion indicated by arrow 57. Tongue 54 in turn is fixed to sleeve 58 which is slidably mounted on arm crank section 48*c* and is restrained at the outward end by stop 59. Sleeve 58 provides for sliding motion indicated by arrow 60 and rotational motion as indicated by arrow 61.

This multi-dimensional freedom of motion imparted by apparatus 49 allows the user to simulate the proper motion of swimming. Not only do the user's arms move at the shoulder correctly and extend and retract at the appropriate points in the stroke, but also the user can rotate his wrist as necessarily occurs during the normal upward portion of the swimming stroke, without releasing his grip or position on handgrips 50.

Figure 5:
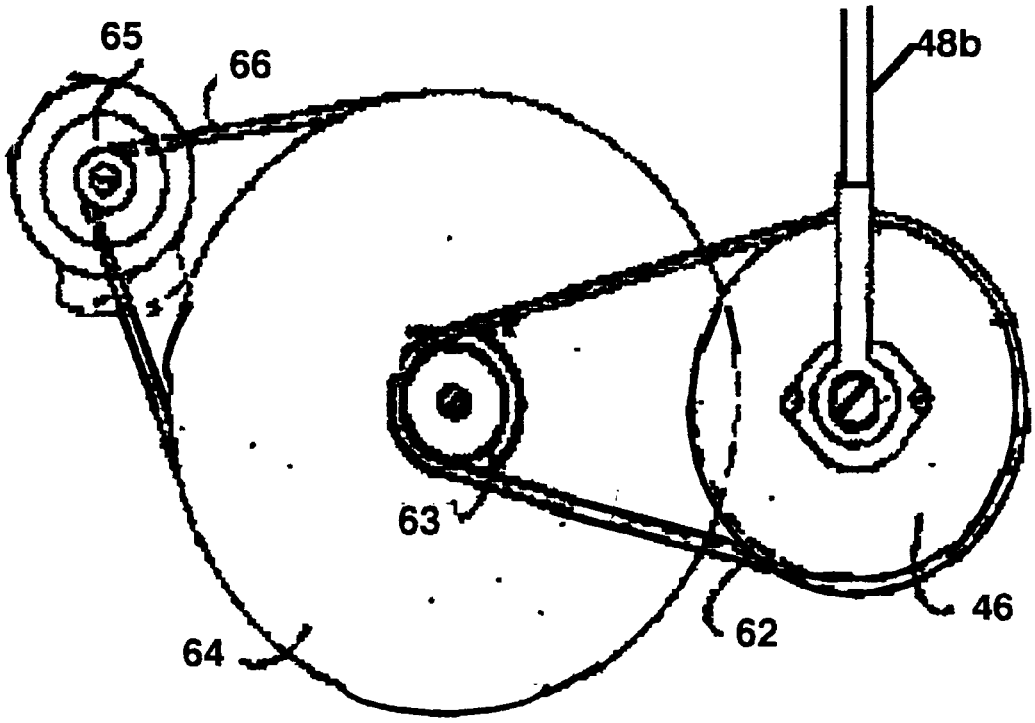
FIG. 5 is a detail view of the pedal mechanism of my invention.

The details of the pedal mechanism are shown in FIG. 5. Movement of telescopic arm cranks 48 rotates pedal mechanism drive sprocket 46, which causes a chain 62 to drive a small diameter sprocket 63 attached to a flywheel 64. The variable load which the operator must overcome in order to rotate sprocket 46 is preferably generated by an alternator 65, which provides a variable resistance to the operator's effort through its driving connection with flywheel 64 by a gear belt 66. The alternator is of the known variety—being a generator with an electromagnet therein.

The present invention is not intended to be limited to any one type of variable load. The variable load could be provided by alternative resistance means well known in the art such as frictional force, hydraulic fluid, gas, disc-braking band, edge engaging braking roller, etc.

While not shown, it is envisioned that the chain and gears of pedal mechanism 43 and alternator 65 would be covered by a housing for neatness of appearance, acoustic insulation, and safety.

Again, referring to FIG. 1 there is illustrated a swim machine in accordance with the present invention that employs a stair climber mechanism 69 for simulating the leg motions of swimming.

Plate 71 is attached to seat base 33 and seat sleeve 36 with stability provided by tubular member 70. As will be described, many of the various stair climber components are mounted on the plate. The central location of the components, between the legs of the user, provides stability to the apparatus and allows for a lightweight and simple design.

Operation of right and left leg levers is identical and will only be described once. Sleeves 72 and inserts 73 are on opposite sides of the plate 71 and pivotally mounted to seat base 33 by leg lever dowel 74. The length of the leg levers is adjusted by set pins 24 through sleeve location holes 25 and into corresponding insert adjustment holes 26. The user's legs engage the leg levers by cushioned rolls 77 rotatably mounted to foot swivel bracket 75 by cushioned roll dowels 78. Foot swivel bracket 75 is pivotally mounted to leg levers by foot swivel dowel 76. Pivoting of the foot swivel bracket allows for the distance between cushioned rolls to conform to the thickness of the user's leg.

Figure 3:
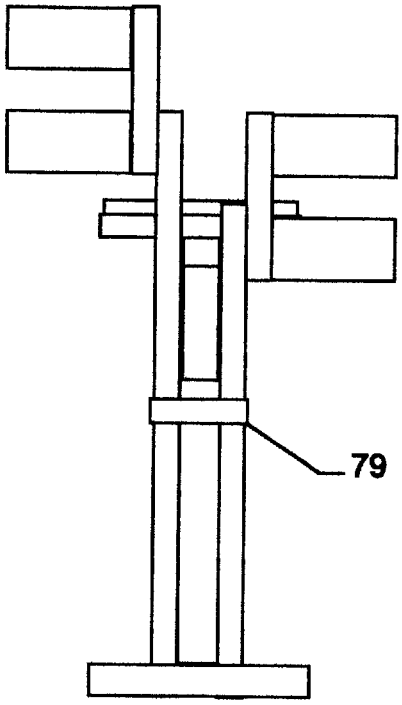
FIG. 3 is a rear view of my invention.

A leg lever link 79 as shown in FIG. 3 allows for locking the leg levers together when performing the dolphin kick of the butterfly stroke.

Figure 6:
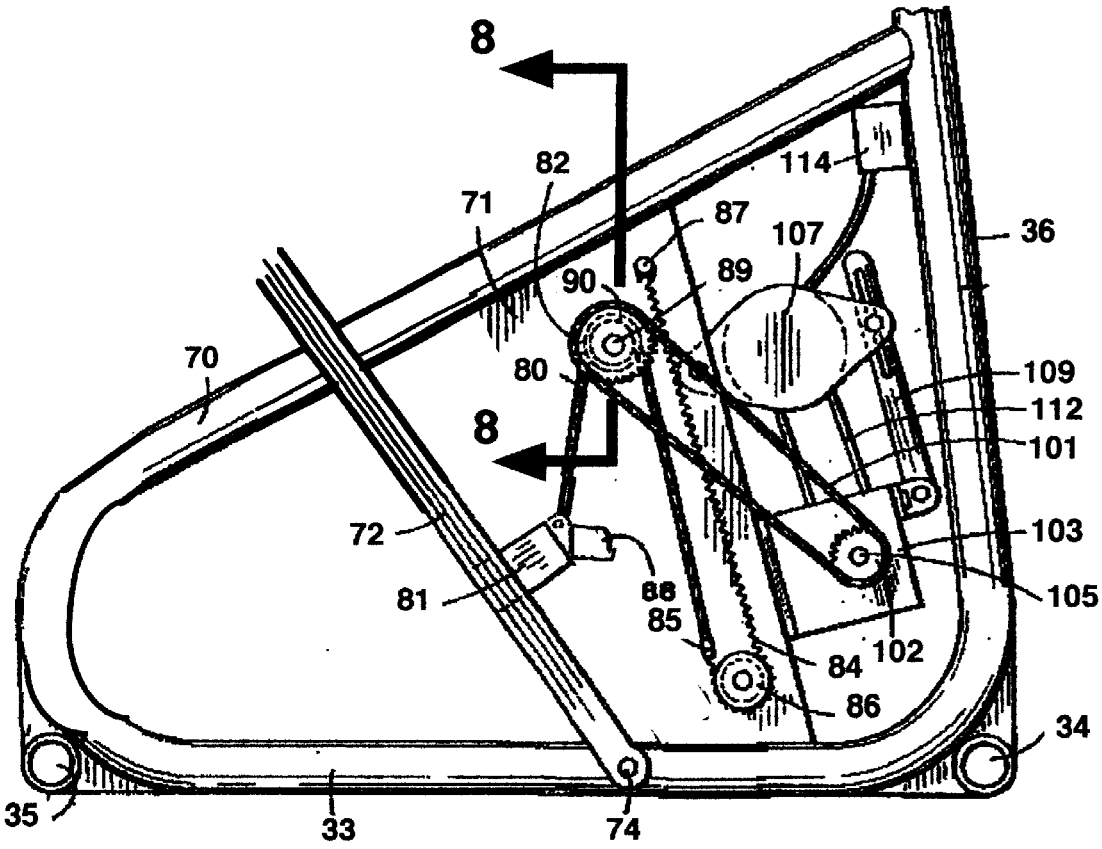
FIG. 6 is a detail view of the stair climber mechanism of my invention.
Figure 7:
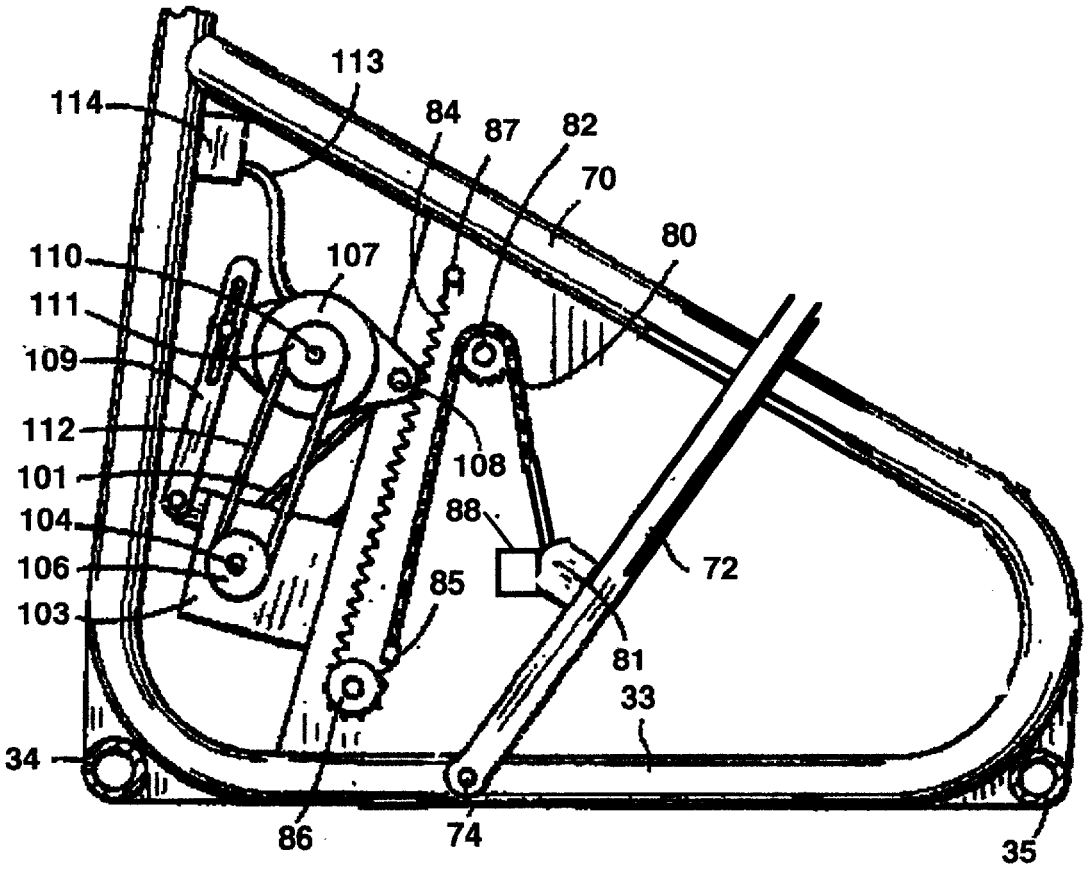
FIG. 7 is a detail view of the stair climber mechanism of my invention.

The details of the stair climber mechanism are shown in FIGS. 6 and 7. One end of a right chain 80 is attached to winglet 81 that extends from the right leg lever sleeve 72. The chain 80 is made to pass over and drivingly engage the teeth of a right sprocket 82 which is part of a drive system assembly 83, best seen in cross-section in FIG. 8. The chain is connected at its other end to a spring 84 by a connector 85. The spring travels over a guide sheave or pulley wheel 86 rotatably mounted on the plate and terminates at a hanger 87 secured to the plate 71. The spring 84, attached to the chain 80, and, in turn, attached to the leg lever 72, is of sufficient tension to keep the lever in the upright position when not in use. The lever will be raised until the winglet 81 rests against a stop 88 welded to the plate 71.

When the user kicks downward, the spring will stretch to allow the chain to move over the right sprocket and allow the lever to move downward toward the floor. When the user's leg is lifted, the spring will cause the lever to return to the upright position. The kicking motion of the exerciser, thus, activates the leg lever.

Figure 8:
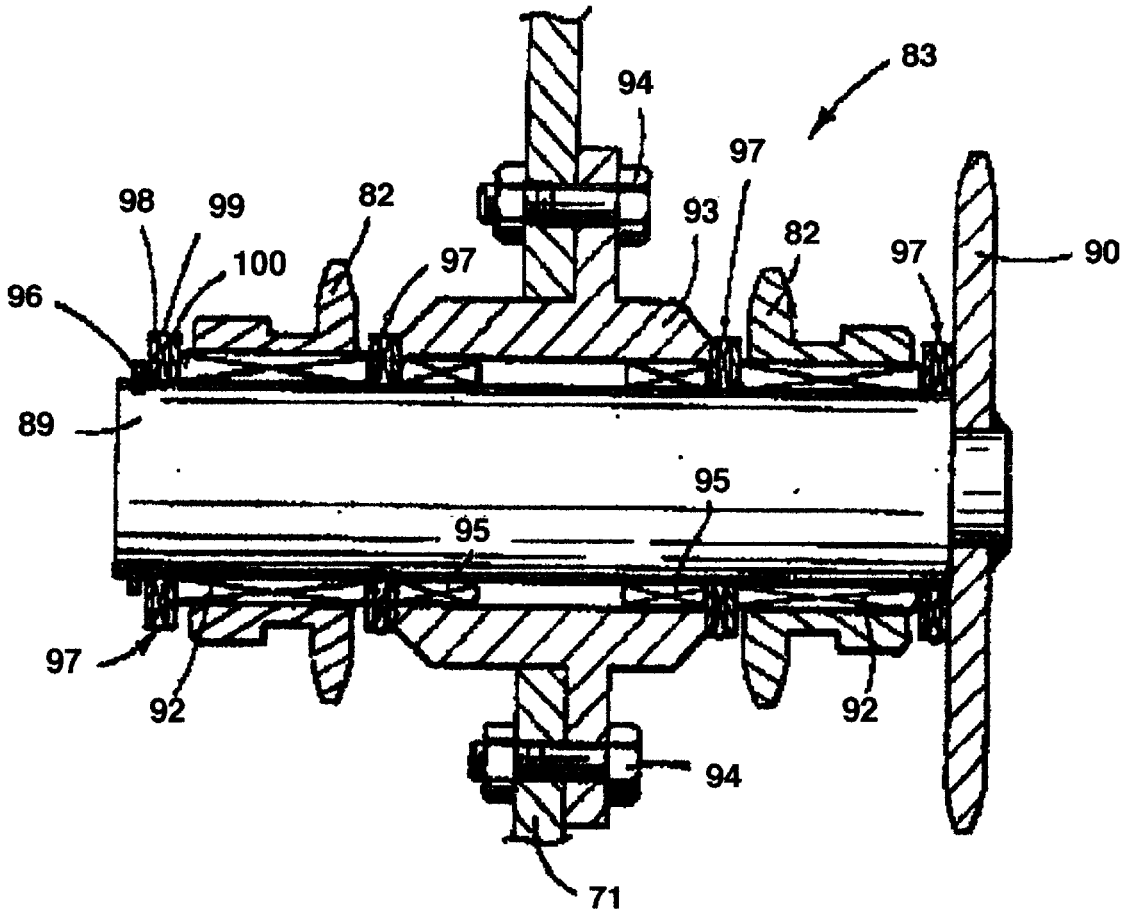
FIG. 8 is a detail view of the drive system assembly of the stair climber mechanism of my invention.

The drive system assembly 83, seen in detail in FIG. 8, includes a central driveshaft 89 having a drive sprocket 90 welded thereto. Surrounding the shaft are left and right sprockets 82. The sprockets operate in conjunction with clutch bearings 92. When the sprocket turns counterclockwise, the sprocket 82 and clutch bearings 92 positively lock with the shaft 89 to turn the shaft counterclockwise. This occurs when the right lever is being depressed. Thus, when the shaft 89 is rotated counterclockwise, the drive sprocket 90 will likewise be rotated counterclockwise. When the right sprocket is turned clockwise (when the right lever is returning to position at rest), the right sprocket and clutch bearing will overrun so that the shaft 89 and the drive sprocket 90 remain stationary. Thus, torque is transmitted to the shaft and drive sprocket in one direction only.

The drive system assembly 83 is secured by a hub 93 to the plate 71 with bolts 94. Pin bearings 95 separate the hub from the shaft. A snap ring 96 is on the end of the shaft opposite the drive sprocket 90. A separator series 97 comprising a thrust washer 98 thrust bearing 99 and thrust washer 100 surrounds the shaft. A separator series 97 separates the snap ring 96 from the left sprocket 82, the left sprocket from the hub 93, the hub from the right sprocket 82, and the right sprocket from the drive sprocket 90.

It is important to note that left and right sprockets 82 operate independently of each other, resulting in independent operation of the left and right leg levers. The asymmetrical range of motion of the levers is desirable, particularly in rehabilitation and medical applications.

FIGS. 6 and 7 illustrate the drive system assembly operation. When either the left or right leg lever is depressed, the driveshaft 89 will be rotated counterclockwise. Continuous chain 101 is engaged with the teeth of the drive sprocket 90 and engaged with the teeth of a transmission sprocket 102. The transmission sprocket 102 rotates an input shaft 105 of a transmission 103 secured on side to the plate 71. The transmission contains a series of gears (not shown) which act as a speed increaser. An output shaft 104 extends from the transmission on the opposite side from the input shaft 105 and terminates in a transmission tooth pulley 106. By way of example and not by way of limitation, the output shaft 104 will rotate at twenty times the speed of the input shaft 105.

An alternator 107 is secured on one side to the plate 71 by means of bolt 108. The alternator is also slidably secured to bar 109. The alternator is of the known variety—being a generator with an electromagnet therein. The alternator includes an alternator shaft 110 and an alternator tooth pulley 111. The transmission tooth pulley 106 and alternator tooth pulley 111 are connected by continuous belt 112. As can be seen from the foregoing, the user provides the energy to operate the alternator 107. The alternator is connected by leads 113 to a load resistor 114 secured to seat sleeve 36. The load resistor is capable of absorbing the electrical energy output of the alternator. When the alternator 107 reaches a certain speed, the voltage is transferred to the load resistor. The work of the user is, thus, dissipated in the form of heat.

While not shown, it is envisioned that the chain and gears of drive system assembly 83 and alternator 107 would be covered by a housing for neatness of appearance, acoustic insulation, and safety.

Finally, while not shown, it is envisioned that the exercise apparatus would include an electronic control system, which would simultaneously determine the loading of the alternators for both the pedal mechanism 43 and stair climber mechanism 69. A microcomputer would communicate electronically with the alternators through a keyboard and a display panel. The keyboard would be used to manually input a stored exercise program or select a random program. The display panel would provide status of the program and measurements on progress of the user.

The use of an alternator is a very desirable means of providing workload, both because of its readily and precisely controllable loading, and also because of its usefulness in supplying the circuitry of the system with current. The alternator, in other words, is both a convenient source of electricity and an inductive element having output parameters which are easily monitored and which may be controlled by a single input variable from the microcomputer.

I claim:

1. An exercise apparatus to simulate motions associated with swimming comprising:

a platform to support a user comprising at least a first section and a second section, each of said first and second sections having a support member independently adjustable of the other;

a frame to support said platform at a height above the floor; and an arm exercise mechanism comprising a rotating pedal mechanism affixed to said frame along the axial centerline of said platform; and having a crank shaft a pair of cranks means for connecting each crank to said pedal mechanism crank shaft at a first end and having a hand attachment portion at a second end, each said crank permitting three dimensional motion by said user in performing the arm rotation associated with a swimming stroke; and a means for varying resistance of said pedal mechanism.

2. An exercise device as recited in claim 1, further comprising:

a leg exercise mechanism comprising a pair of leg support bars extending outward from said frame and essentially parallel to said axial centerline, said leg support bars each including a leg attachment portion and capable of single plane movement relative to said frame, and a means for varying resistance of said leg support bars.

3. An exercise device as recited in claim 1, wherein each said crank is attached to said pedal mechanism by a universal joint.

4. An exercise device as recited in claim 1, wherein each said handle attachment portion is attached to said crank by a universal joint.

5. An exercise device as recited in claim 1, wherein said handle attachment portion is a handgrip.

6. An exercise device as recited in claim 1, wherein the length of each said crank is adjustable.

7. An exercise device as recited in claim 2, wherein said leg support bars are operatively attached to said resistance means, which in turn is secured to said frame.

8. An exercise device as recited in claim 2, wherein each said leg attachment portion comprises a pair of leg rolls on opposite sides of the leg of the user.

9. An exercise device as recited in claim 2, wherein the position of each said leg attachment portion is adjustable along said leg support bar.

10. An exercise device as recited in claim 1, wherein said resistance means is computer controlled.

11. An exercise device as recited in claim 1, wherein said support member is a vertical support member.

12. An exercise device as recited in claim 1, wherein said platform is adapted for prone or supine operation by a user.

13. An exercise device as recited in claim 1, wherein said first section is a torso support and the second section is a seat or pelvic support.

14. An exercise device as recited in claim 1, wherein said resistance means comprises an alternator.

* * * * *